US008758321B2

(12) United States Patent
Stacey et al.

(10) Patent No.: US 8,758,321 B2
(45) Date of Patent: Jun. 24, 2014

(54) SYSTEM AND METHOD FOR ACTIVE COOLING OF STORED BLOOD PRODUCTS

(75) Inventors: Gary Stacey, Marshfield, MA (US); Robert E. Putt, Braintree, MA (US); Michael R. D'Arrigo, Weymouth, MA (US); Robert Lancelot, Deer Park, IL (US); Timothy Olaska, Naperville, IL (US); Steven Portela, Somerville, MA (US); Frank Jason Black, Spring Valley, CA (US)

(73) Assignee: Haemonetics Corporation, Braintree, MA (US)

( * ) Notice: Subject to any disclaimer, the term of this patent is extended or adjusted under 35 U.S.C. 154(b) by 260 days.

(21) Appl. No.: 12/779,444

(22) Filed: May 13, 2010

(65) Prior Publication Data

US 2011/0082437 A1 Apr. 7, 2011

Related U.S. Application Data

(60) Provisional application No. 61/178,004, filed on May 13, 2009.

(51) Int. Cl.
*A61B 19/00* (2006.01)
*F25D 3/08* (2006.01)

(52) U.S. Cl.
USPC ..... 604/403; 604/408; 604/410; 62/457.1

(58) Field of Classification Search
USPC ..... 62/407, 457.9, 457.1; 604/6.13, 6.15, 604/317, 323, 403, 404, 408, 410
See application file for complete search history.

(56) References Cited

U.S. PATENT DOCUMENTS

| | | | | |
|---|---|---|---|---|
| 4,126,016 | A | 11/1978 | Greiner | 62/457 |
| 4,457,140 | A | 7/1984 | Rastelli | 62/261 |
| 5,086,627 | A | 2/1992 | Borgen | 62/229 |
| 5,111,664 | A | 5/1992 | Yang | 62/3.62 |
| 5,186,020 | A | 2/1993 | Rockenfeller et al. | 62/457.9 |
| 5,187,945 | A | 2/1993 | Dixon | 62/234 |

(Continued)

FOREIGN PATENT DOCUMENTS

| | | | |
|---|---|---|---|
| DE | 598350 | 6/1934 | |
| DE | 10010718 | 9/2001 | B65D 81/18 |
| WO | WO 02/31417 | 4/2002 | F25D 3/06 |
| WO | WO 2006100412 A1 * | 9/2006 | |

OTHER PUBLICATIONS

English language machine translation of WO 2006/100412.*

(Continued)

*Primary Examiner* — Leslie Deak
(74) *Attorney, Agent, or Firm* — Sunstein Kann Murphy & Timbers LLP

(57) ABSTRACT

A portable blood storage device includes an outer housing an inner housing. The outer housing defines the structure of the blood storage device. The inner housing is located within the outer housing and has an interior cavity for storing collected blood and/or blood components. The inner housing has an open top to allow access to the interior cavity. The storage device also has an inlet duct and a return duct located within the interior cavity. The inlet duct is fluidly connectable to a cooling device and brings conditioned air into the storage device when fluidly connected to the cooling device. The return duct is also fluidly connectable to the cooling device and returns exhaust air to the cooling device when fluidly connected.

22 Claims, 14 Drawing Sheets

(56) References Cited

U.S. PATENT DOCUMENTS

| | | | | |
|---|---|---|---|---|
| 5,433,082 | A | 7/1995 | Trulaske | 62/255 |
| 5,622,059 | A | 4/1997 | McClellan | 62/448 |
| 6,378,324 | B1 * | 4/2002 | Percy et al. | 62/448 |
| 6,848,433 | B2 * | 2/2005 | Scoggins | 123/541 |
| 7,065,980 | B1 | 6/2006 | Knight | 62/457.9 |
| 7,251,954 | B2 | 8/2007 | Fee et al. | 62/448 |
| 7,677,246 | B2 * | 3/2010 | Kepler et al. | 128/204.18 |
| 2003/0060761 | A1 * | 3/2003 | Evans et al. | 604/113 |
| 2004/0139757 | A1 * | 7/2004 | Kuehl et al. | 62/237 |
| 2004/0194494 | A1 | 10/2004 | Wilkinson | 62/407 |
| 2005/0077228 | A1 * | 4/2005 | Pasqualini | 210/321.72 |
| 2005/0283913 | A1 * | 12/2005 | Heaton et al. | 5/615 |
| 2006/0179724 | A1 * | 8/2006 | Lee | 52/79.1 |
| 2007/0029006 | A1 * | 2/2007 | Lampropoulos | 141/311 A |
| 2007/0078369 | A1 * | 4/2007 | Tamari | 604/6.15 |
| 2009/0013706 | A1 * | 1/2009 | Sato et al. | 62/239 |
| 2009/0193830 | A1 * | 8/2009 | Yoshioka | 62/239 |

OTHER PUBLICATIONS

International Searching Authority, International Search Report—International Application No. PCT/US2010/034639, dated Mar. 23, 2011, together with the Written Opinion of the International Searching Authority, 18 pages.

International Bureau of WIPO, International Preliminary Report on Patentability—International Application No. PCT/US2010/034639, dated Nov. 24, 2011, together with the Written Opinion of the International Searching Authority, 12 pages.

* cited by examiner

SYSTEM AND METHOD FOR ACTIVE COOLING OF STORED BLOOD PRODUCTS

PRIORITY

This patent application claims priority from U.S. provisional patent application No. 61/178,004, filed May 13, 2009, entitled, "System and Method For Active Cooling of Stored Blood Products," and naming Gary Stacey, Robert E. Putt, Michael R. D'Arrigo, Timothy Olaska, Steven Portela and Jay Black as inventors, the disclosure of which is incorporated herein, in its entirety, by reference.

TECHNICAL FIELD

The present invention relates to storage of blood and blood products, and more particularly to devices that provide active cooling of stored blood and blood products.

BACKGROUND ART

The United States Food and Drug Administration ("FDA") determines storage requirements for all blood and blood products. Among other things, the FDA requires that blood and/or blood products be stored within a specific temperature range. For example, after 8 hours, whole blood must be stored between 1 and 6 degrees Celsius. During transport, the whole blood must be kept between 1 and 10 degrees Celsius. Additionally, the FDA requirements also state that, after collection, blood products may only be outside of the specified temperature range for prescribed (brief) period of time. If the temperature of the blood or blood products remains outside of the target temperature range for longer than the allowed time, the blood and blood products must be disposed of. As one may expect, loss and disposal of any blood or blood product is wasteful and costly.

Furthermore, the FDA guidelines become more of an issue when one considers that blood and blood products are not always collected and immediately processed or placed within a fixed storage device or location. In most instances, the blood and/or blood products must be transported to a different location for permanent processing, storage, and/or use.

Currently, hospitals and blood donation organizations transport collected/stored blood and blood products in a consumer-type cooler (e.g., similar to those used to store beverages and food) with ice packs, bags of ice, or dry ice, for example. This method provides only limited transport time and cannot ensure that the stored blood and blood products remain within the target temperature range (e.g., the temperature may be above or below the target range). Additionally, this method cannot ensure that all of the blood and/or blood products within the cooler are at the same temperature (e.g., some of the blood product containers may be within the temperature range and others may not because of the uneven cooling provided by ice packs). Lastly, this method is unable to provide any information regarding how long the blood product has been stored and for how long the blood product was outside of the target temperature range. Therefore, in many instances, if the ice pack melts during transport and there is uncertainty as to whether or not the blood went over the target temperature, the blood and/or blood products must be disposed of. In other instances, the temperature of the blood or blood products is sampled at the processing center. If the blood or blood product falls within the specified range, the blood or blood product is cleared for processing even though the blood or blood unit may have been outside of the specified range at any point since collection.

SUMMARY OF THE INVENTION

In a first embodiment of the invention, there is provided a portable biological-material storage device including an insulating housing, an inlet duct, and a return duct. The insulating housing may define the structure of the biological-material storage device and may have an interior cavity for storing biological material. The insulating housing may have an open top to allow access to the interior cavity. The inlet duct may be fluidly connectable to a conditioning device and may be located within the interior cavity of the storage device. The inlet duct may bring conditioned air into the storage device when fluidly connected to the conditioning device. The return duct may be fluidly connectable to the conditioning device and located within the interior of the storage device. The return duct may return exhaust air to the conditioning device when fluidly connected to the conditioning device.

In accordance with additional embodiments, there is provided a portable blood storage device including an outer housing and an inner housing. The outer housing defines the structure of the blood storage device. The inner housing may be located within the outer housing and may have an interior cavity for storing collected blood and/or blood products/components. The inner housing may also have an open top to allow access to the interior cavity.

The portable blood storage device may also have an inlet duct and an outlet duct within the interior cavity. Both the inlet duct and the outlet duct may be fluidly connectable to a cooling device. The inlet duct may bring conditioned air (e.g., warmed, cooled, or otherwise conditioned) into the storage device when fluidly connected to the cooling device. The return duct may return exhaust air to the cooling device when fluidly connected to the cooling device. The inlet and outlet ducts may have openings extending along the length of the ducts. The openings allow conditioned air within the inlet duct to enter the interior cavity and exhaust air within the interior cavity to enter the return duct.

In accordance with some embodiments of the present invention, the inner housing may be spaced from the outer housing to create a volume between the inner housing and the outer housing. The volume between the inner and outer housing may contain an insulator medium to help maintain the temperature within the storage device.

The portable blood storage device may also have a shroud located across the open top of the inner housing. The shroud may have a plurality of openings that extend through it and allow access to the interior cavity. Each of the plurality of openings may have a flap member(s) (or other flexible member) that prevents warm/ambient air from entering the interior cavity through the open top and prevents conditioned air within the interior cavity from exiting the interior cavity through the open top.

In accordance with further embodiments, the storage device may also have an inlet docking assembly and an outlet docking assembly. The inlet docking assembly may be located between the inlet duct and the cooling device, and may automatically create fluid communication between the inlet duct and the cooling device when the storage device is docked with the cooling device. The return docking assembly may be located between the return duct and the cooling device and may automatically create fluid communication between the return duct and the cooling device when the storage device is docked with the cooling device. When fluid communication is created, exhaust air may be returned to the cooling device, and conditioned air may be transferred from the cooling device to the inlet duct.

The inlet docking assembly may include a primary inlet door and a secondary inlet door. The primary inlet door may open as the storage device is docked with the cooling device. The primary inlet door may also open the secondary inlet door as it opens to create the fluid communication between the inlet duct and the cooling device The return docking assembly may include a primary return door and a secondary return door. The primary return door may open as the storage device is docked with the cooling device. The primary return door may also open the secondary return door as it opens to create fluid communication between the return duct and the cooling device. When the storage device is removed from the cooling device, the doors (e.g., the primary inlet door, the secondary inlet door, the primary return door, and the secondary return door) may automatically close to fluidly disconnect the inlet and return ducts from the cooling device.

In accordance with still further embodiments, the portable blood storage device may also include at least one temperature sensor located within the interior cavity. The temperature sensors may measure the temperature within the storage device at various locations. The storage device may also have an electrical connector in electrical communication with the temperature sensor and electrically couplable with the cooling device. The electrical connector may transfer blood storage device data to the cooling device.

In accordance with further embodiments, there is provided a portable cooling device for use with a blood storage device. The portable cooling device may have a cart chassis, a cart housing, a blood storage device support member, and at least one refrigeration unit. The cart chassis may define the structure of the portable cooling device and the cart housing may surround and enclose the chassis. The blood storage device support member may have a raised state and a lowered state. When in the lowered state, the support member may support a blood storage device. When in the raised state the support member may be substantially flush against the cart housing. The support member may also include a support leg that extends downward from the bottom surface of the support member and supports the support member against the floor. The portable cooling device may also have wheels or casters mounted to the chassis to allow the portable cooling device to be moved/transported.

The refrigeration unit(s) may be contained within the chassis and may be fluidly connected to the blood storage device when the blood storage device is supported by the support member and/or when the blood storage device is positioned on the cart and/or support member. The refrigeration unit may have a supply port and a return port. The supply port may be fluidly connected to an inlet duct on the blood storage device to allow conditioned air to be transferred to the blood storage device. The return port may be fluidly connected to a return duct on the blood storage device to allow exhaust air from the blood storage device to be returned to the portable cooling device.

The blood storage device support member may include a plate that may longitudinally slide within the support member to position the blood storage device to fluidly connect the supply and return ports with the inlet duct and return ducts. The plate may also have a first registration detail that corresponds to a second registration detail located on the blood storage device. The first and second registration details may orient the blood storage device on the plate.

Additional embodiments of the portable cooling device may also have a refrigeration chassis on which the refrigeration unit(s) may be mounted. The refrigeration chassis may be removable from the portable cooling device to allow for easy maintenance and/or replacement of components.

The portable cooling device may also have a cooling device electrical connector and a refrigeration control unit. The cooling device electrical connector may be in electrical communication with an electrical connector on the blood storage device when the blood storage device is fluidly connected to the refrigeration unit(s). The cooling device electrical connection may transmit data to and/or receive data from the blood storage device. The refrigeration control unit may be in communication with at least one refrigeration unit, and may control the operation of the refrigeration unit(s) based, at least in part upon, the data received by the cooling device electrical connector.

In accordance with additional embodiments, the portable cooling device may also include an embedded server for storing the data received by the cooling device electrical connection, and a wireless router or wireless access point device. The wireless router/access device may wirelessly transmit the data to and/or receive data from external devices. The portable cooling device may also have a battery back-up located within the chassis. The battery back-up may provide power to the refrigeration units, embedded server, wireless router and/or the wireless access point device if power is lost to the portable cooling device.

In accordance with still further embodiments, an active blood storage and cooling system is provided. The active blood storage and cooling system may include a portable cooling device and a blood storage device. The portable cooling device may have a refrigeration unit with a supply port and a return port. The blood storage device may have an interior cavity for storing blood products. The storage device may also have an inlet duct, and a return duct within the interior cavity. The blood storage device may be dockable with the portable cooling device. When docked, the supply port may fluidly connect to the inlet duct and the return port may fluidly connect to the return duct. The portable cooling device may send conditioned air to the blood storage device through the supply port and inlet duct and receive exhaust air through the return duct and return inlet.

The portable cooling device may include a blood storage device support member that may be oriented in a raised state or a lowered state. When in the lowered state, the support member may support the blood storage device. The support member may also include a plate that may longitudinally slide within the support member. The plate may position the blood storage device to fluidly connect the cooling and return ports with the inlet duct and return ducts on the blood storage device. The plate may have a first registration detail that corresponds to a second registration detail on the blood storage device. The registration details may orient and/or align the blood storage device on the plate.

In accordance with additional embodiments, the blood storage device may further include at least one temperature sensor within the interior cavity to measure the temperature within the blood storage device, and an electrical connector in electrical communication with the temperature sensor. The blood storage device may include a control module with a user interface that displays the blood storage device temperature and/or average temperature over time.

The portable cooling device may also have an electrical connector that is in electrical communication with the connector on the storage device when the blood storage device is docked with the portable cooling device. When connected, the storage device may transfer data to the portable cooling device. The portable cooling device may also include a control unit that controls the operation of the refrigeration unit(s) based, at least in part upon, the received data. The portable cooling device may store the data on an embedded server and/or wirelessly transmit the data to external devices using a wireless router/access device within (or external to) the cooling device.

In accordance with other embodiments, the storage device may have a wireless module that may send the blood storage data to an external device. The storage device may also include a location tracker (e.g., GPS) that tracks the location of the blood storage device during transport. The blood storage data may include the temperature within the blood storage device, a target temperature and/or range, a length of time that the stored blood components have been stored within the blood storage device, a length of time that the interior cavity has been above the target temperature, a quantity of blood product stored within the blood storage device, the type of blood product stored within the blood storage device, the location of the blood storage device, etc.

In accordance with additional embodiments, a portable storage device having an insulating housing, an inlet duct, and a return duct is provided. The insulating housing may define the structure of the blood storage device and may having an interior cavity for storing blood and blood components. The insulating housing may have an open top to allow access to the interior cavity. The inlet duct may be fluidly connectable to a cooling device and may be located within the interior cavity of the storage device. The inlet duct may bring conditioned air into the storage device when fluidly connected to the cooling device. The return duct may be fluidly connectable to the cooling device and located within the interior of the storage device. The return duct may return exhaust air to the cooling device when fluidly connected to the cooling device.

BRIEF DESCRIPTION OF THE DRAWINGS

The foregoing features of the invention will be more readily understood by reference to the following detailed description, taken with reference to the accompanying drawings, in which.

DETAILED DESCRIPTION OF SPECIFIC EMBODIMENTS

In illustrative embodiments, a blood storage device may be used in conjunction with a portable cooling device to provide active cooling of the interior of the blood cooling device and, therefore, active cooling of stored blood and blood products. As discussed in greater detail below, embodiments of the present invention are able to maintain stored blood and blood products at the proper temperature and ensure that the blood and blood products are not stored above or below allowable temperature limits.

It is important to note that some embodiments of the present invention may also be used for storage and transportation of a variety of biological materials. For example, the storage device may be used to cool, store, and transport organs, tissues, cells, cellular material, and/or other biological material and tissue.

Figure 1:
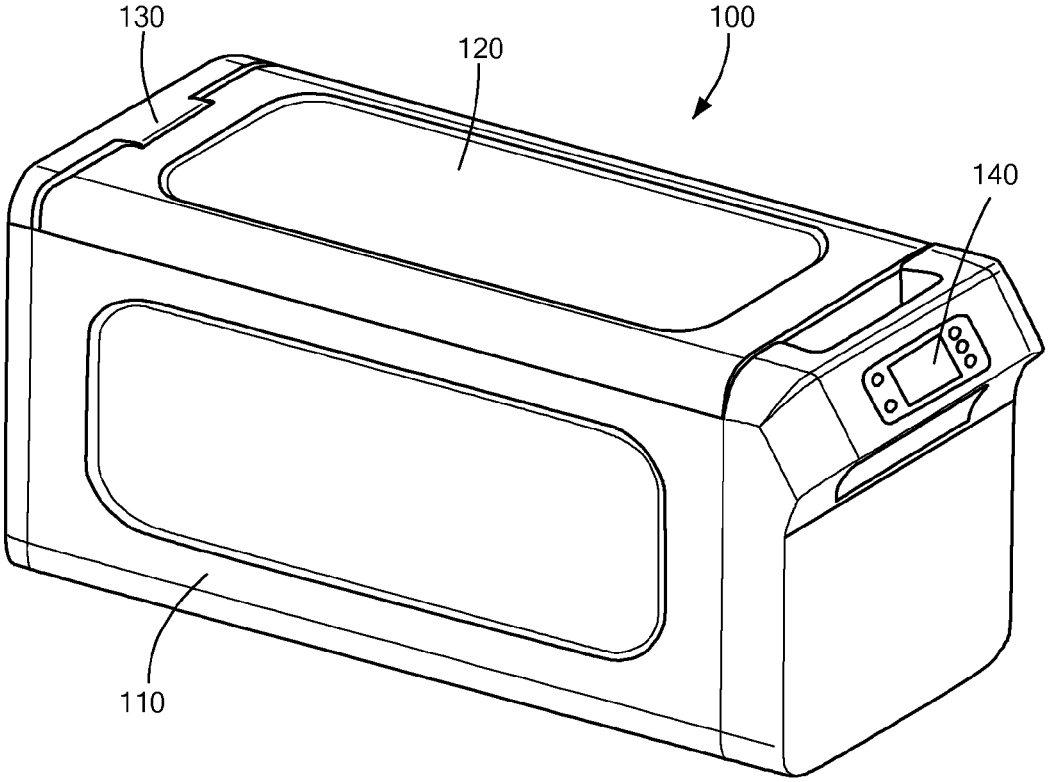
FIG. 1 is a perspective view of a portable blood storage device, in accordance with embodiments of the present invention.

FIG. 1 shows a perspective view of one embodiment of a blood storage device 100 in accordance with embodiments of the present invention. As can be seen in the figure, the blood storage device 100 may have a shape and size similar to typical coolers that, as described above, are currently being used for blood storage and transport. The blood storage device 100 may have a body 110 and a lid 120. The body 110 defines the structure of the storage device 100 and has a cavity in which the blood and blood products may be stored. The lid 120 may be connected to the body 110 with a hinge 130 that allows the lid to be opened and closed (e.g., to allow access to the internal cavity within the storage device 100).

As described in greater detail below, the blood storage device 100 may also have a control module 720 (FIG. 7B) with a user interface 140 that allows a user to view the temperature within the storage device 100 as well as additional information relating to the storage device 100 and the blood and blood components stored within the device 100. In some embodiments, the user interface 140 may also be used to increase or decrease a target temperature within the storage device 100 or control/adjust other operational parameters.

Figure 2A:
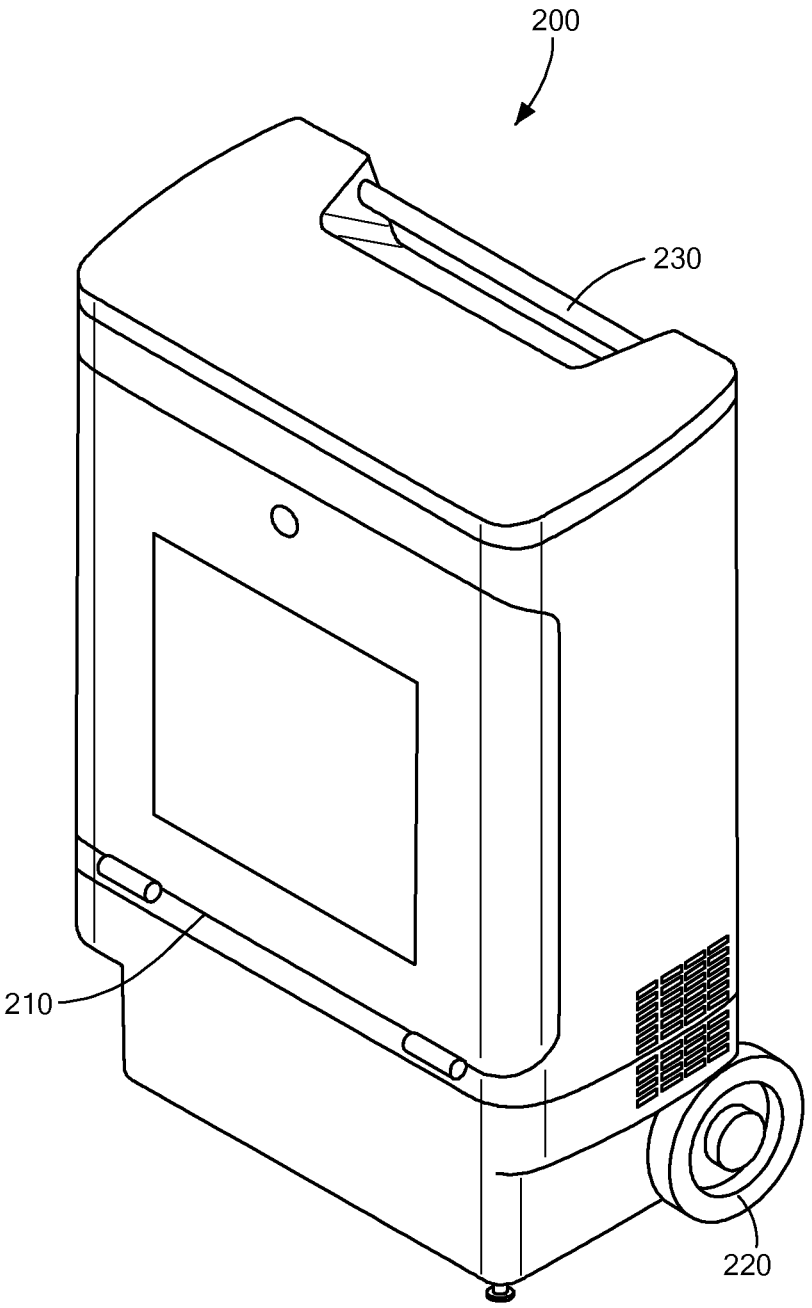
FIG. 2A is a perspective view of a portable cooling device, in accordance with embodiments of the present invention.
Figure 2B:
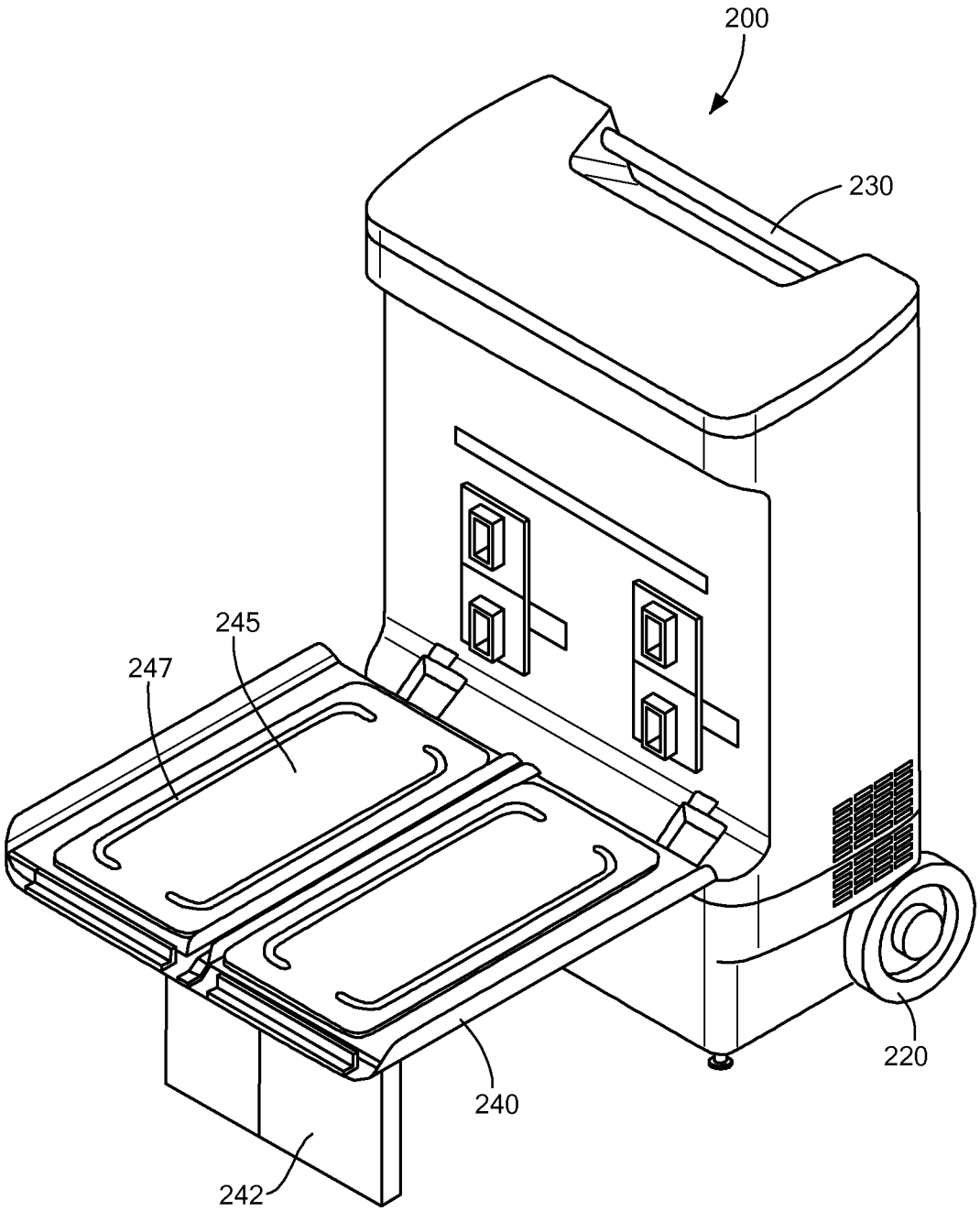
FIG. 2B is a perspective view of the portable cooling device shown in FIG. 2A with a storage device support member lowered, in accordance with embodiments of the present invention.

As mentioned above, the blood storage device may be used in conjunction with a portable cooling device 200 to provide active cooling within the storage device 100. FIGS. 2A and 2B show perspective views of an exemplary portable cooling device 200. In general, the portable cooling device 200 has body 210 and a pair of wheels 220 (or casters, treads, etc.) that allow the cooling device 200 to be moved (e.g., rolled) from location to location. The cooling device 200 may also have a handle 230 that a user may hold onto while transporting the cooling device 200.

Figure 2C:
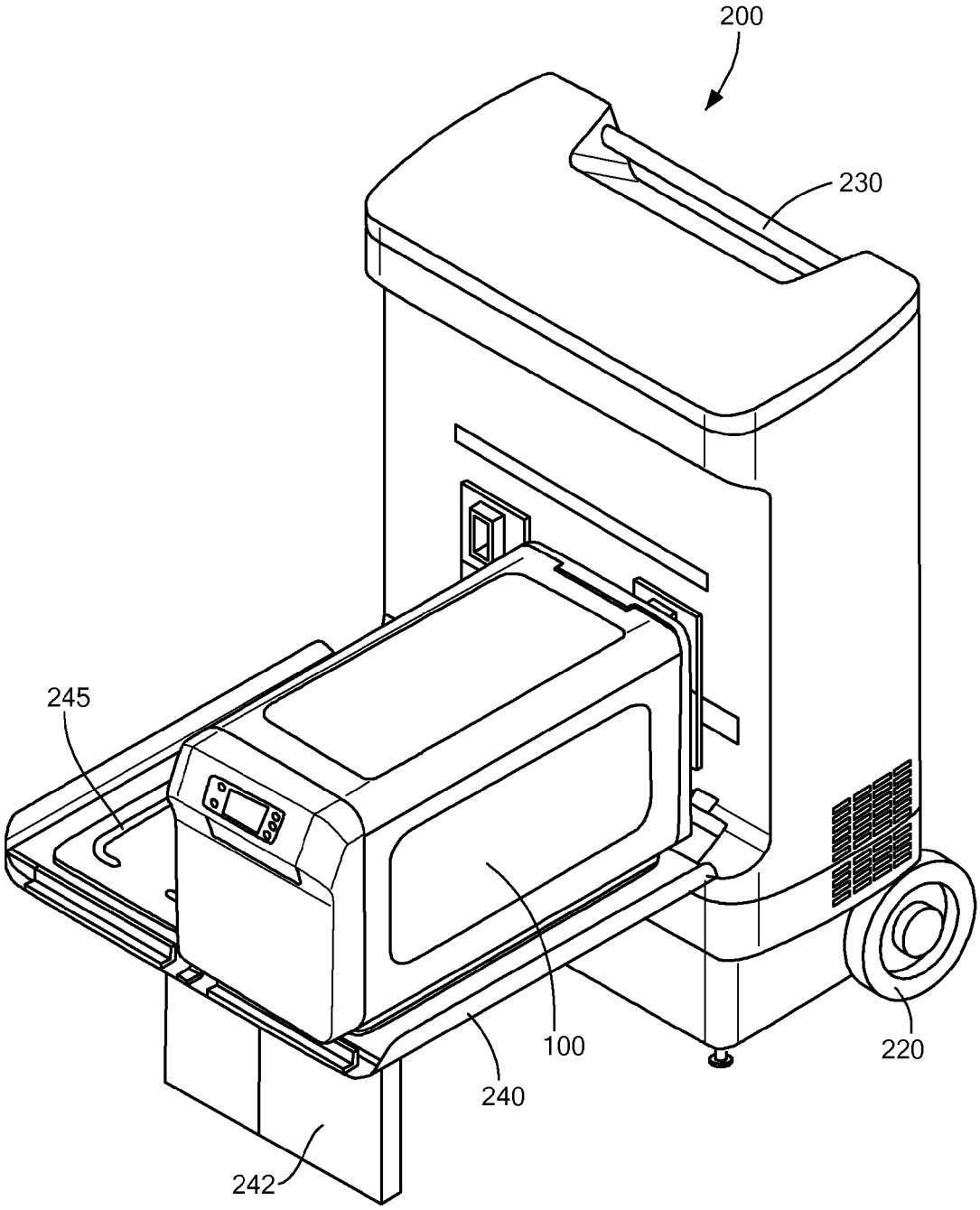
FIG. 2C is a perspective view of the portable cooling device shown in FIG. 2A with a storage device support member lowered and the storage device shown in FIG. 1 docked with the cooling device, in accordance with embodiments of the present invention.

The portable cooling device 200 may essentially have two states—a transport state (FIG. 2A) and a cooling state (FIGS. 2B and 2C). When in the transport state, shown in FIG. 2A, a user may easily transport the cooling device 200 by tilting the cooling device 200 backwards using the handle 230 and pushing the cooling device 200. The wheels 220 (or casters, treads, etc.) will allow the cooling device 200 to easily roll to the new location. When in the cooling state, shown in FIG. 2B, the cooling device 200 may be used to connect with and actively cool the storage device 100 (e.g., as shown in FIG. 2C). To transform from the transport state to the cooling state, the cooling device 200 may have a storage device support platform 240 that drops down from the body 210. As shown in FIG. 2C, the storage device 100 may be placed on and supported by the support platform 240. To provide additional support, the support platform 240 may have a support leg 242 that extends down from the bottom surface of the support platform 240. The support leg 242 may be used to support the support platform 240 against the floor and prevent bending or breaking of the support platform 240 (e.g., when the storage device 100 is placed on the platform 240). The individual components of and the interaction between the storage device 100 and the cooling device 200 will now be described in greater detail.

Figure 3:
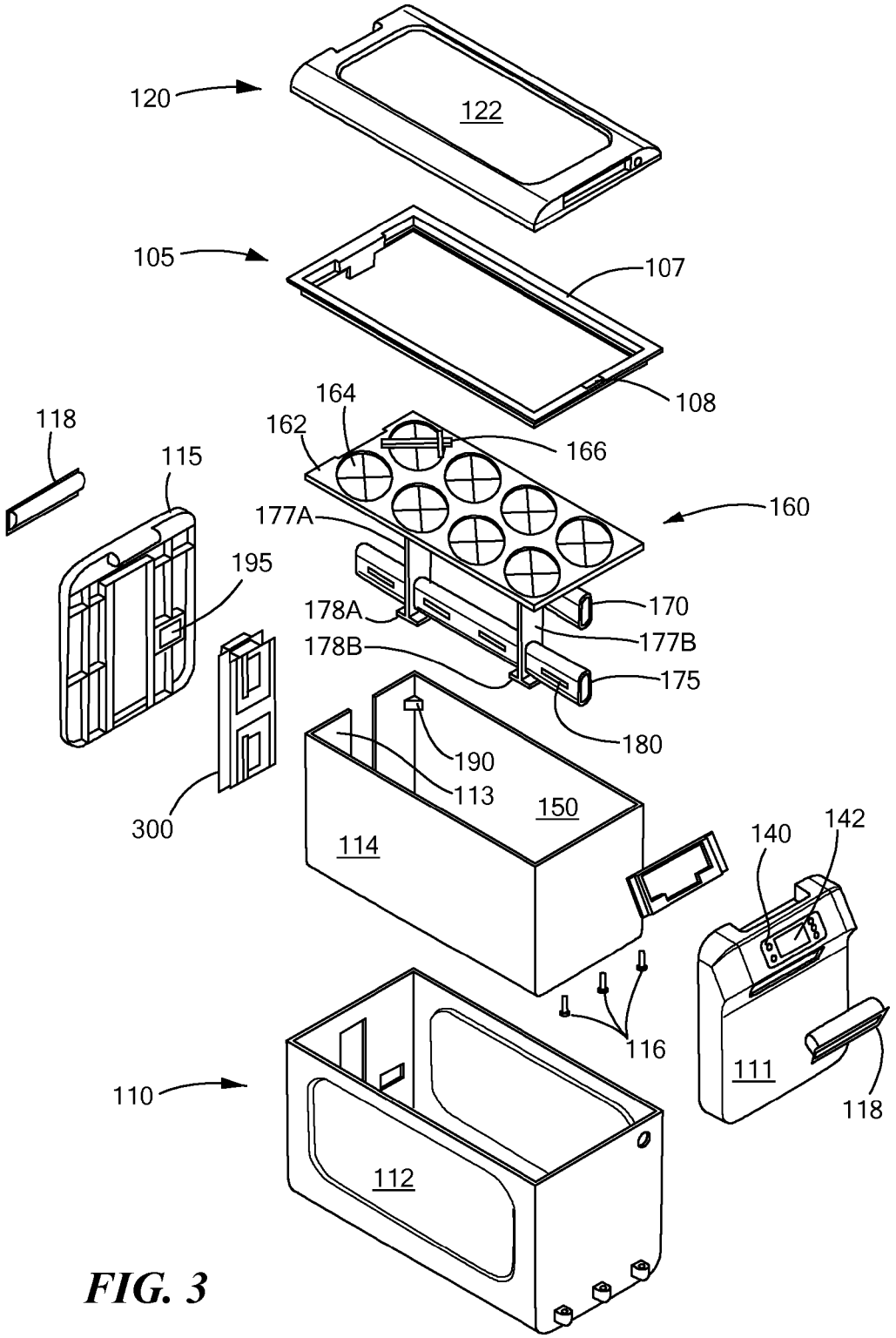
FIG. 3 is a perspective exploded view of the portable blood storage device shown in FIG. 1, in accordance with embodiments of the present invention.

FIG. 3 shows an exploded view of an embodiment of the storage device 100. As shown in FIG. 3, the storage device body 110 can have an inner housing 114 and an outer housing 112, each having an open top to allow access into the internal cavity 150 of the storage device 100. The body 110 may be fully insulated in order to help maintain the temperature within the interior of the storage device 100. To that end, the inner housing 114 and the outer housing 112 may be spaced apart to provide an area in which an insulation material, fluid, or other medium may be contained. For example, the insulation material/fluid/medium may be a liquid (e.g., water), a gas (e.g., air or other suitable gas), or other material (e.g., a foam). The inner housing 114 and the outer housing 112 may be secured together in a variety of ways including, but not limited to screws 116. The body may also have a back cover 115, a front cover 111, and a top 105. The top 105 may extend over and help secure the inner housing 114 and the outer housing 112 to one another. As discussed in greater detail below, the top 105 may also have a gasket 106, a ridge 107 for supporting a shroud 160, and a magnet or metal plate 108 to help keep the lid 120 closed.

It should be noted that, although the storage device body 110 is described above as having an inner housing 114 and an outer housing 112, other embodiments of the present invention may only have a single walled housing. For example, the storage device 100 may have a single insulating housing that helps maintain the temperature within the storage device 100.

As one may expect, the opening and closing of the blood storage device 100 (e.g., to insert and/or remove the blood or blood products) may allow the cold/conditioned air contained within the internal cavity 150 to escape and warm/ambient air to enter the storage device 100. To prevent this loss of cold/conditioned air, some embodiments of the present invention may have a shroud 160 beneath the lid 120 and covering the internal cavity 150. Therefore, when the lid 120 is opened to insert or remove the blood and/or blood products, the shroud 160 will keep the cold/conditioned air within the storage device 100 and prevent warm/room air from entering. The shroud 160 may rest on the ridge 107 of the body top 105.

In order to allow a user to insert and remove the blood and blood products from the internal cavity 150 of the storage device 100, the shroud 160 may have a series of passageways 162 extending through the shroud 160. The passageways 162 may contain a normally closed, cut membrane, a flexible member, or a series of normally closed flaps 164 that prevent the cold/conditioned air from escaping, but still allow a user to insert the blood and/or blood products into the storage device 100. For example, a user may push a blood bag through the passageway 162 causing the normally closed flaps 164 to open. Then, as the user removes their hand from the passageway 162, the flaps 164 will close, keeping the cold/conditioned air within the storage device 100.

As mentioned above, some embodiments of the present invention allow for active cooling within the storage device 100. To that end, the storage device 100 may include ductwork within the interior cavity 150. For example, the storage device 100 may include an inlet duct 170 and a return duct 175. As described in greater detail below, the inlet duct 170 may be used to transfer cold and/or conditioned air from the cooling device 200 into the interior cavity 150 of the storage device 100. Conversely, the return duct 175 may be used to transfer warm/exhaust air within the storage device 100 back to the cooling device 200 for cooling/conditioning and recirculation back to the storage device 100. The inlet duct 170 and the return duct 175 may have holes or slots 180 along the length of the ducts to allow cold/conditioned air to enter the internal cavity 150 from the inlet duct 170 and warm/exhaust air from the internal cavity 150 to enter the return duct 175. It should be understood that the term "warm air" as used herein refers to air that is warmer relative the cold/conditioned air that enters the storage device 100 and warmer relative to the target temperature range.

As shown in FIG. 3, the inlet duct 170 and the return duct 175 can be tubular structures that span across at least a portion of the interior cavity 150. It is important to note that the term "tubular" does not require a circular/round cross-sectional shape. For example, as shown in FIG. 3, the inlet duct 170 and the return duct 175 can have an oblong (e.g., generally rectangular with rounded corners) cross-sectional shapes.

Also, because the slots 180 may be spaced along the length of the inlet duct 170, the slots 180 allow for even distribution of the cold/conditioned air within the internal cavity 150. For example, the inlet duct 170 may have a slot 180 located near each of the passageways 162. In this manner, each of the blood bags will essentially have their own slot 180 supplying cold/conditioned air. This may help prevent uneven cooling of the stored blood and blood products within the storage device 100. Additionally or alternatively, the slots 180 may be sized to allow even airflow and/or cooling within the storage device 100. For example, the slots 180 may be different sizes to assist with even air distribution along the inlet duct 170.

As shown in FIG. 3, the inlet duct 170 and the return duct 175 may be secured to and supported by the shroud 160 by support arms 177A/177B. For example, the support arms 177A/177B may extend downward from the bottom surface of the shroud 160 and the inlet duct 170 and outlet duct 175 may pass through (or otherwise be secured to) the support arms 177A/177B. The support arms 177A/177B may also have foot members 178A/178B that rest on the bottom of the inner housing 114 and help support the ducts 170/175 and the shroud 160 within the internal cavity 150 of the storage device 100.

Figure 4:
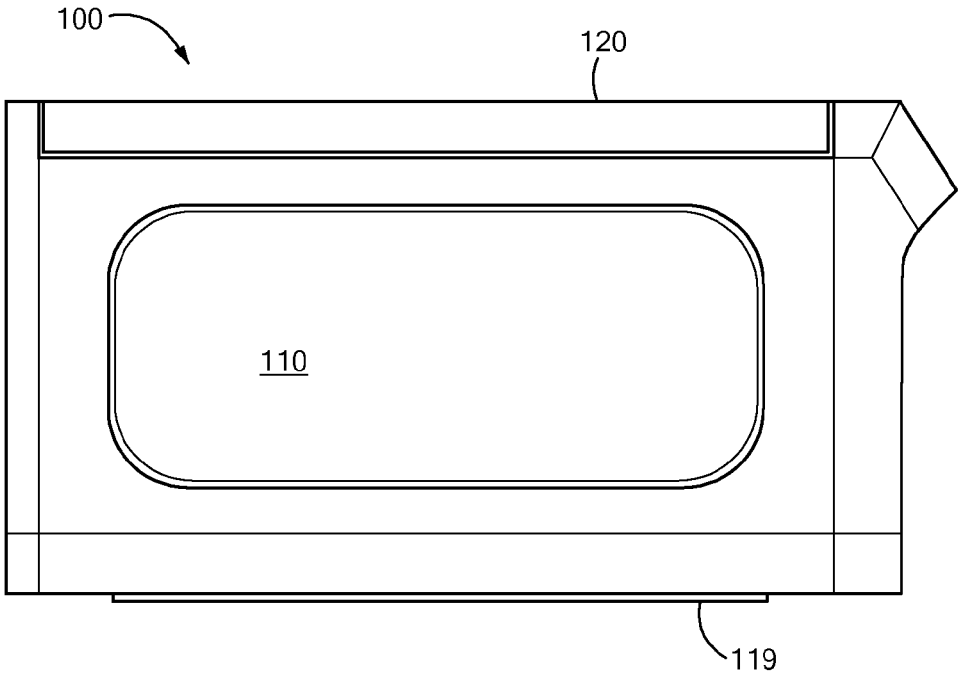
FIG. 4 is a side view of the portable blood storage device shown in FIG. 1, in accordance with embodiments of the present invention.

The storage device 100 may also have a variety of components that aid in transportation and stacking of the storage devices 100. For example, the storage device 100 may have handles 118 located at either side of the storage device 100 that allow a user to easily lift and carry the storage device 100. Additionally, the lid 120 may be designed to allow multiple storage devices 100 to be stacked. For example, the lid 120 may have an indent 122 (or other physical feature or apparatus) sized to accommodate a protrusion 119 (or physical feature or apparatus) on the bottom of the storage device 100 (see FIG. 4).

Additionally, to keep the blood and blood components secured within the storage device 100, the disposable sets 710 (e.g., the collection bags 711, 712, 713 in FIG. 7B), in which the blood and blood components are collected, may include a bar or a clip 166. The bar/clip 166 may pass through a hole/slit in the top of the blood bag and may be configured such that blood bags may hang below the bar/clip 166 within the internal cavity 150. The bar/clip 166 may span the passageways 162 and rest on the top surface of the shroud 160 (see FIGS. 3 and 7A). The flaps 164 may then close around the portion of the blood bag extending through the passageway 162.

Figure 5:
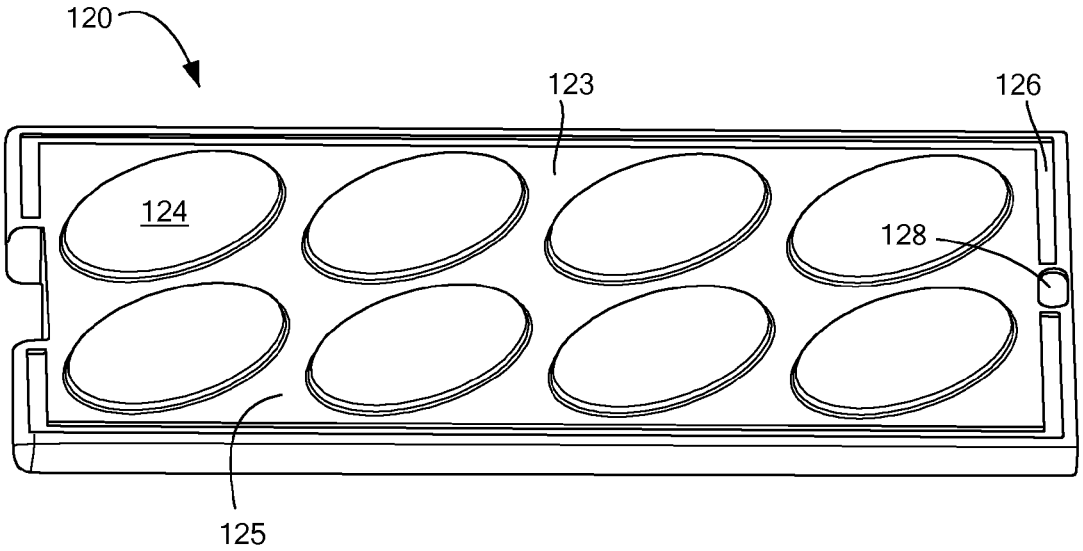
FIG. 5 is a bottom view of the lid of the portable blood storage device shown in FIG. 1, in accordance with embodiments of the present invention.

In accordance with some embodiments, the lid 120 may also aid in securing the disposable sets in their respective passageway 162. For example, the underside 123 of the lid 120 may have protrusions 124 corresponding to each of the passageways 162 (see FIG. 5). These protrusions 124 may push down upon the bar/clip 166 and prevent them from moving and/or falling through the passageway 162. In addition to the protrusions 124, the underside 123 of the lid 120 may have a groove 126 for receiving the gasket 106 on the body top 105 (see FIG. 7B). This allows the lid 120 to seal the storage container 100 when the lid 120 is closed. The lid 120 may also have a magnet 128 (or other latching device) that works in conjunction with the magnet/plate 108 (or other device) on the body top 105 to keep the lid 120 closed.

In order to monitor the temperature within the storage device 100 and ensure that the temperature of the contents does not exceed allowable limits, the storage device 100 may have one or more temperature sensors 190 located within the internal cavity 150. The temperature sensor(s) 190 may monitor the temperature within the storage device 100 (e.g., at various locations) and transmit the temperature data to a variety of devices. For example, the temperature sensor(s) 190 may transmit the temperature data to the control module 720 so that it may be displayed on the user interface 140. Additionally or alternatively, the temperature sensor 190 may be connected to an electrical connector 195 which allows the storage device 100 to transmit the temperature data to external devices such as the cooling device 200. It is important to note that the electrical connector 195 may also be connected to the control module 720 and other sensors and measurement devices and may be used to transmit other data. For example, the electrical connector 195 may transmit information relating to the quantity and type of blood or blood products contained within the storage device (e.g., the information obtained by the RFID scanner mentioned below), the target temperature, the length of time that the blood/blood products have been within the storage device 100, if the temperature exceeded the target temperature and, if so, for how long, to name but a few. As discussed in greater detail below, the storage device may also wirelessly transmit and/or receive data.

In addition to transmitting data, the storage device 100 may also receive data from variety of external devices and/or the cooling device 200. For example, some embodiments of the present invention may have the thermostat/temperature controller located on the cooling device 200. In such embodiments, the storage device 100 may receive information regarding the set-point temperature and display it on the interface 140. Additionally or alternatively, if equipped with a wireless module (discussed in greater detail below) the storage device 100 may wirelessly receive data from handheld devices (e.g., data from handheld RFID scanners, PDAs, etc.).

As mentioned above and as described in greater detail below, various embodiments of the storage device 100 may be docked with the portable cooling device 200 so that the internal cavity 150 and the contents may be actively cooled using the inlet duct 170 and the outlet duct 175. To facilitate the connection of the ducts 170/175 to the ports 860A/B on the cooling device 200 (see FIG. 8) while minimizing the loss of cold/conditioned air within the storage device 100, the storage device 100 may have a docking assembly 300 that automatically opens when the storage device 100 is docked with the cooling device 200.

Figure 6A:
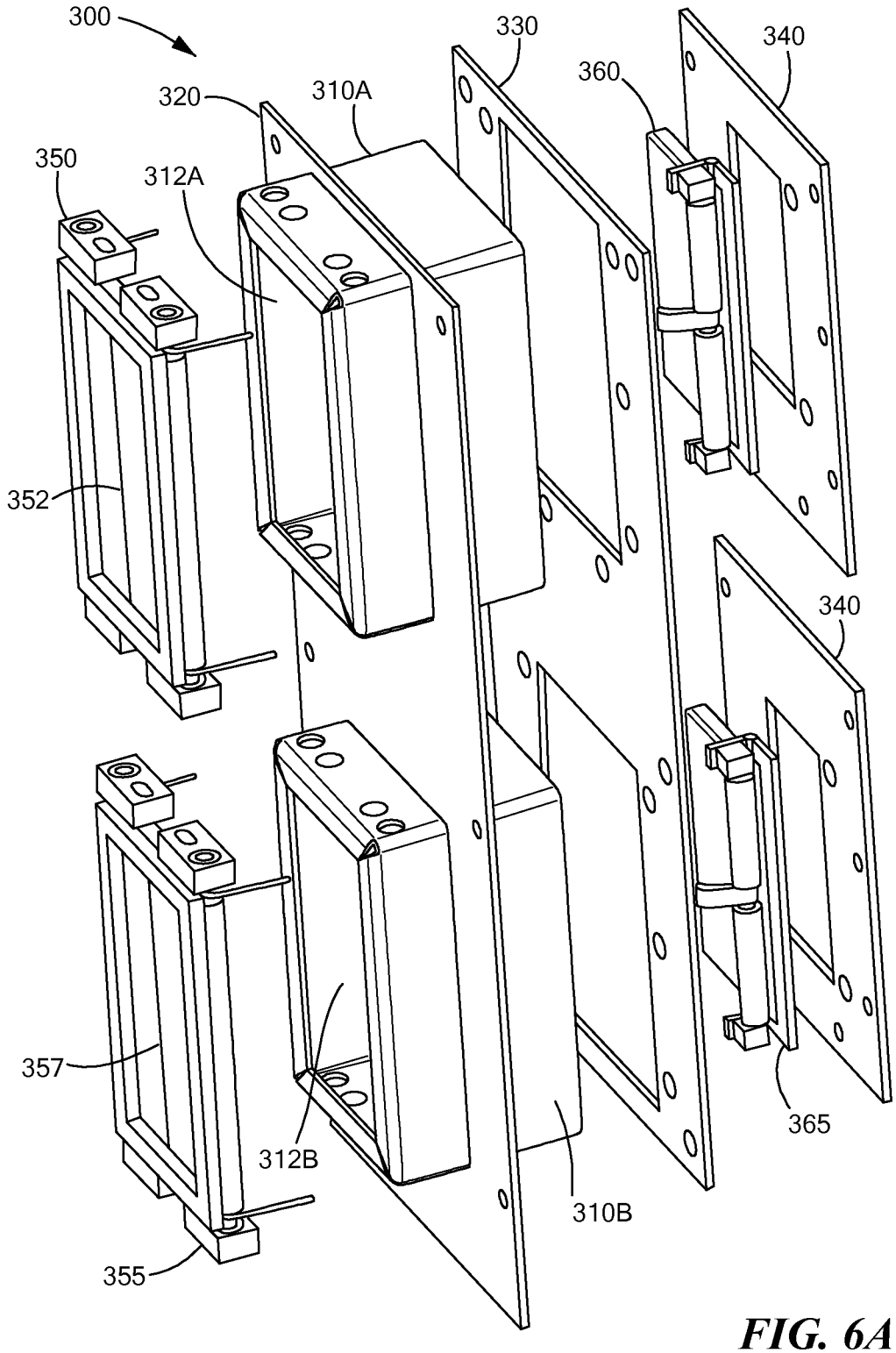
FIG. 6A shows an exploded view of a docking assembly for the storage device shown in FIG. 1, in accordance with embodiments of the present invention.
Figure 6B:
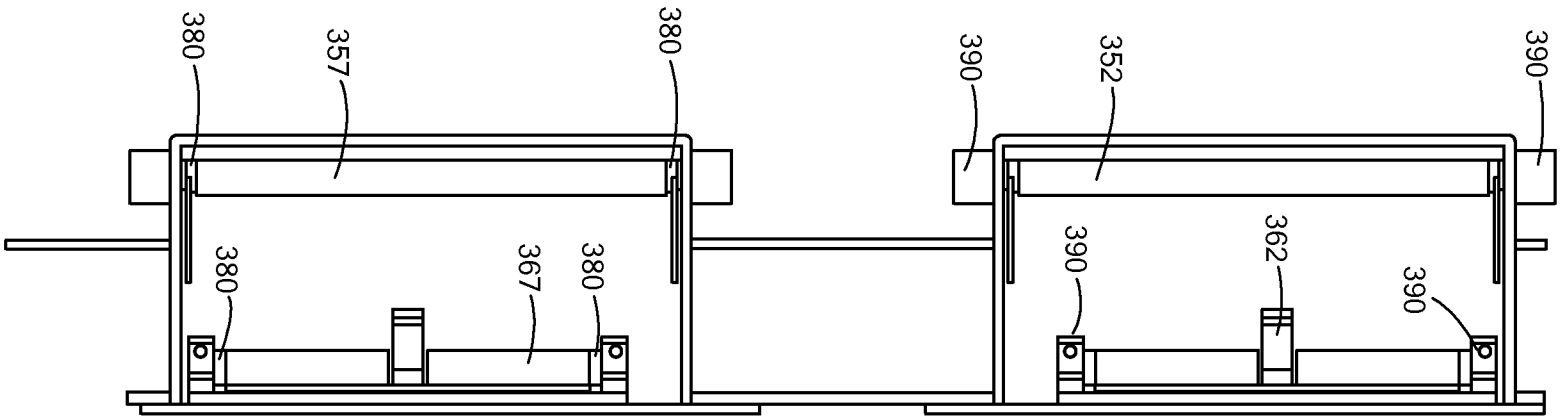
FIG. 6B shows a side cross-sectional view of the docking assembly shown in FIG. 6A, in accordance with embodiments of the present invention.
Figure 6C:
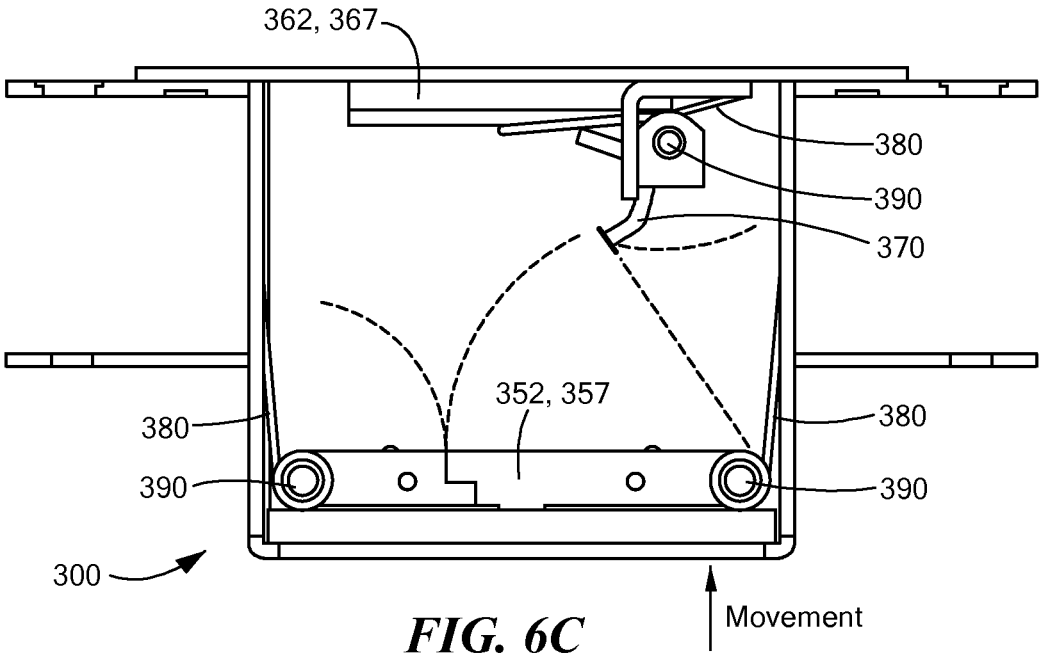
FIG. 6C shows a top cross-sectional view of the docking assembly shown in FIG. 6A, in accordance with embodiments of the present invention.

For example as shown in FIGS. 6A-6C, the docking assembly 300 may have a top housing 310A, a bottom housing 310B, a front panel mount 320, a rear panel mount 330, a mounting plate(s) 340, a pair of primary door assemblies 350/355, and a pair of secondary door assemblies 360/365. Each of the panel mounts 320, 330, and the mounting plate(s) 340 may be used to secure the docking assembly 300 to the storage device 100. For example, the mounting plate(s) 340 may be located on the rear wall 113 of the inner housing 114 within the interior cavity 150, the rear panel mount 330 may be located between the inner housing 114 and the outer housing 112, and the front panel mount 320 may be located on the exterior wall of the outer housing 112. The panel mounts 320/330 and the mounting plate(s) 340 may then be secured to each other and the storage device 100 using, for example, screws or bolts, passing through the mounts 320/330, the plate(s) 340, and the inner and outer housings 112, 114.

The docking assembly housings 310A/310B may pass through openings within the panel mounts 320/330, the mounting plate 340 and the inner and outer housings 112/114. In some embodiments, the docking assembly housings 310A/310B may welded into the front panel mount 320. As best shown in FIG. 6A, each of the docking assembly housings 310A/310B may have an opening 312A/312B to allow cold/conditioned air and returning warm/exhaust air to pass through the housings 310A/310B when the primary door assemblies 350/355 and the secondary door assemblies 360/365 are open and the storage device 100 is docked with the cooling device 200. However, when the primary door assemblies 350/355 and the secondary door assemblies 360/365 are closed, they essentially act as an air lock between the internal cavity 150 and the exterior of the storage device 100.

In order to allow the doors 352/357 of the primary door assemblies 350/355 and the doors 362/367 of the secondary door assemblies to open, the doors may be secured to the assemblies using bearing mounts 390, FIG. 6B. The bearing mounts 390 allow the doors 352/357/362/367 to rotate about an axis and swing open. Additionally, to keep the doors 352/357/362/367 normally closed, the primary door assemblies 350/355 and the secondary door assemblies 360/365 may include torsion springs 380. The torsion springs 380 allow the doors to open when a force is applied. However, when that force is removed, the torsion springs 380 will cause the doors to automatically close.

It should be noted that the top primary door assembly 350 may correspond to the inlet duct 170 and the bottom primary door assembly 355 may correspond to the return duct 175. Likewise, the top secondary door assembly 360 may correspond to the inlet duct 170 and the bottom secondary door assembly 365 may correspond to the return duct 175. Therefore, when both the top primary door assembly 350 and the top secondary door assembly 360 are open, the inlet duct 170 is fluidly connected to the cooling device 200. Additionally, when both the bottom primary door assembly 355 and the bottom secondary door assembly 365 are open, the return duct 175 is fluidly connected to the cooling device 200.

As mentioned above, the docking assembly 300 may automatically open when the storage device 100 is docked with the cooling device 200. To that end, as the storage device 100 is docked with the cooling device 200, the doors 352/357 on the primary door assemblies 350/355 open (e.g., the evaporator ports 860A/B push the primary doors 352/357 open) exposing the openings 312A/312B within the assembly housings 310A/310B. As the primary doors 352/357 open further (e.g. as shown in FIG. 6C), the primary doors 352/357 may contact a lever 370 within the secondary door assembly 360/365. As the primary doors 352/357 push this lever 370, the secondary doors 362/367 within the secondary door housings 360/365 will begin to open. When the storage device 100 is fully docked, the primary doors 352/357 and the secondary doors 362/367 will be open, allowing air flow in an out of the inlet and return ducts 170/175. Additionally, when the storage device 100 is undocked from the cooling device 200, the torsion springs 380 mentioned above cause the primary doors 352/357 and the secondary doors 362/367 to automatically close to prevent cold/conditioned air from escaping from and warm/ambient air from entering the internal cavity 150.

Figure 7A:
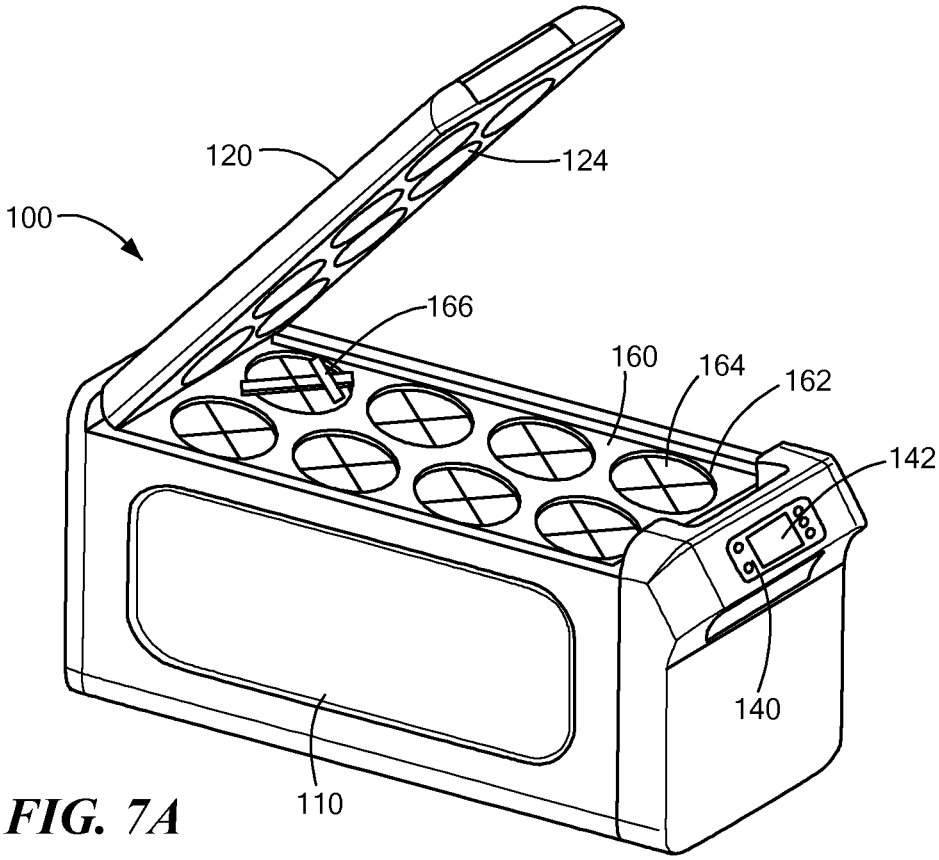
FIG. 7A shows a perspective view of the storage device shown in FIG. 1 with the lid open, in accordance with embodiments of the present invention.

FIG. 7A shows a storage device 100 in accordance with some embodiments of the present invention with the lid 120 open to illustrate the configuration of the shroud 160 within the storage device 100. Also, FIG. 7A shows a disposable set hanging from the shroud 160 through a passageway 162 using a bar/clip 166. When the lid 120 is closed the protrusions 124 on the underside of the lid 122 will secure the bar/clip 166 as described above.

Figure 7B:
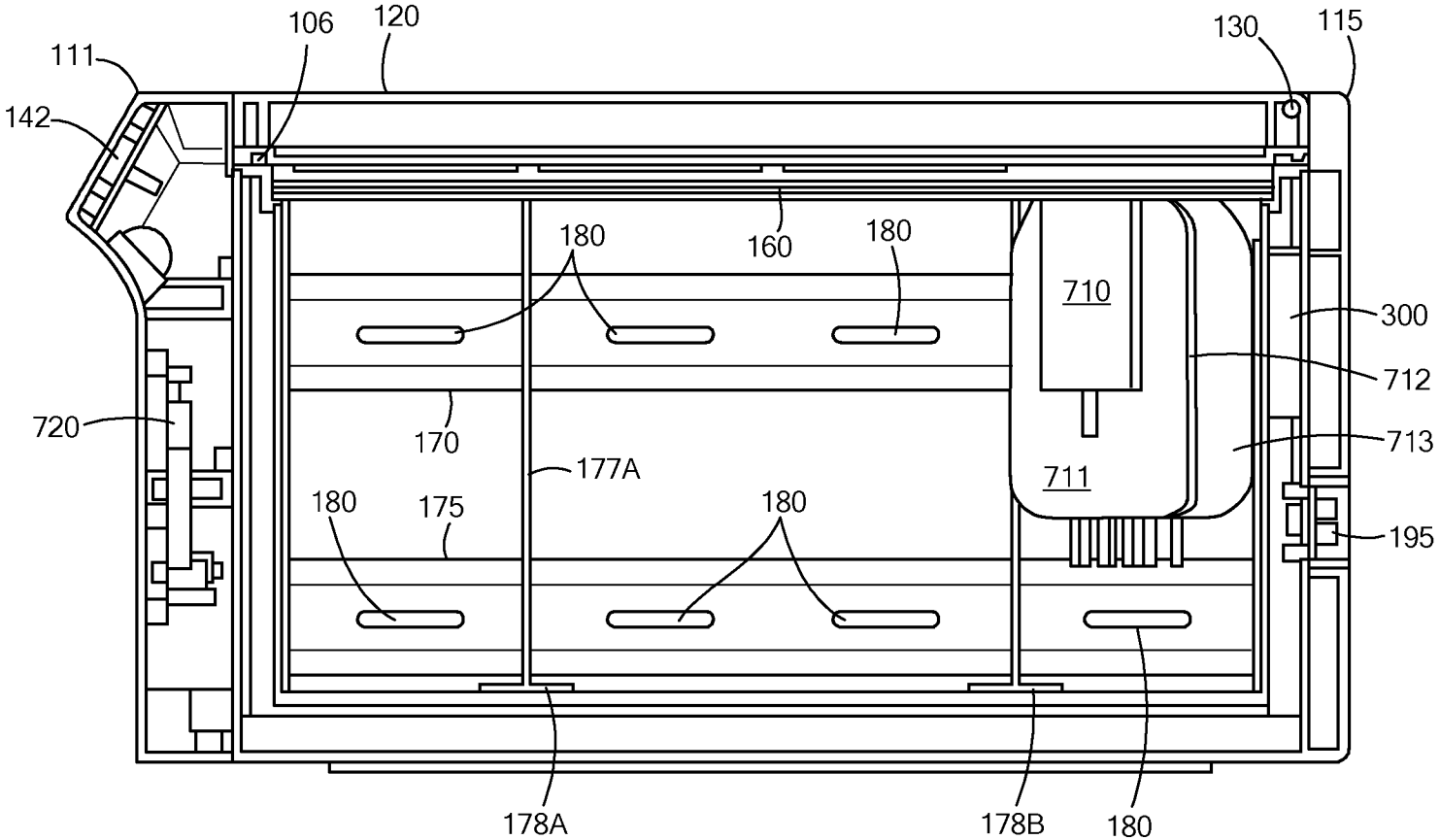
FIG. 7B shows a cross-sectional view of the storage device shown in FIG. 1, in accordance with embodiments of the present invention.

FIG. 7B shows a cross section of an embodiment of a fully assembled storage device 100 with a disposable set 710 within the internal cavity. As shown in FIG. 7B, the disposable set 710 can include several bags 711, 712, 713, one (or more) of which may be filled with blood or blood product (e.g., bag 713). The other bags 711 and 712 may be used when the blood/blood products are further processed after transport. As also shown in FIG. 7B, the inlet duct 170 and the return duct 175 may extend horizontally across the internal cavity 150 and may be supported by duct supports 177A/177B which extend down from shroud 160.

As mentioned above, the storage device 100 can have a controller 720 and a user interface 140 with a display 142. The controller 720 may also have memory that may be used to store time data, temperature data, as well as data regarding the amount and type of blood within the storage device 100. For example, each of the disposable sets 710 that are placed within the storage device may include an information tag that includes pertinent information regarding the disposable set and the type of blood/blood product that it contains. For example, the information tag may include the amount of blood/blood product, target storage temperature, the time that it was collected, the type of blood/blood product (e.g., whole blood, white blood cells, platelets, plasma, etc.), the location that the blood/blood product was collected, and the destination of the blood/blood product. The user may then read this tag and input the information into the control module memory using the user interface 140. Alternatively, the information tag may include a bar code and the information may be scanned in using a scanner (e.g., a bar code scanner), or the information tag may be an RFID tag and an RFID scanner may be used. In such embodiments, the scanner may be in communication with the storage device such that the information is automatically stored in memory. It is important to note that, by storing such information within the storage device 100, a data and temperature log may be created before, during and after transport that provides proof of compliance with regulatory requirements.

The controller 720 may also be used to set and/or adjust the target temperature within the storage device 100 if needed. When the storage device 100 docks with the cooling device 200, the controller 720 may send the storage and blood/blood product information to the cooling device 200 so that the cooling device 200 will begin active cooling at the appropriate temperature. Additionally, the controller 720 may display any of the information on the display 142 on the user interface 140.

As mentioned above, the storage device 100 may have a controller 720 that allows a user to set and/or adjust a target temperature. However, in some embodiments, the cooling device 200 may include a thermostat/temperature controller that allows a user to set and/or adjust the target temperature. In such embodiments, the user interface 140 and/or the controller 720 within the storage device 100 may only include monitoring, storage and display electronics (e.g., a user may not set or adjust the target temperature from the storage device 100).

Figure 8:
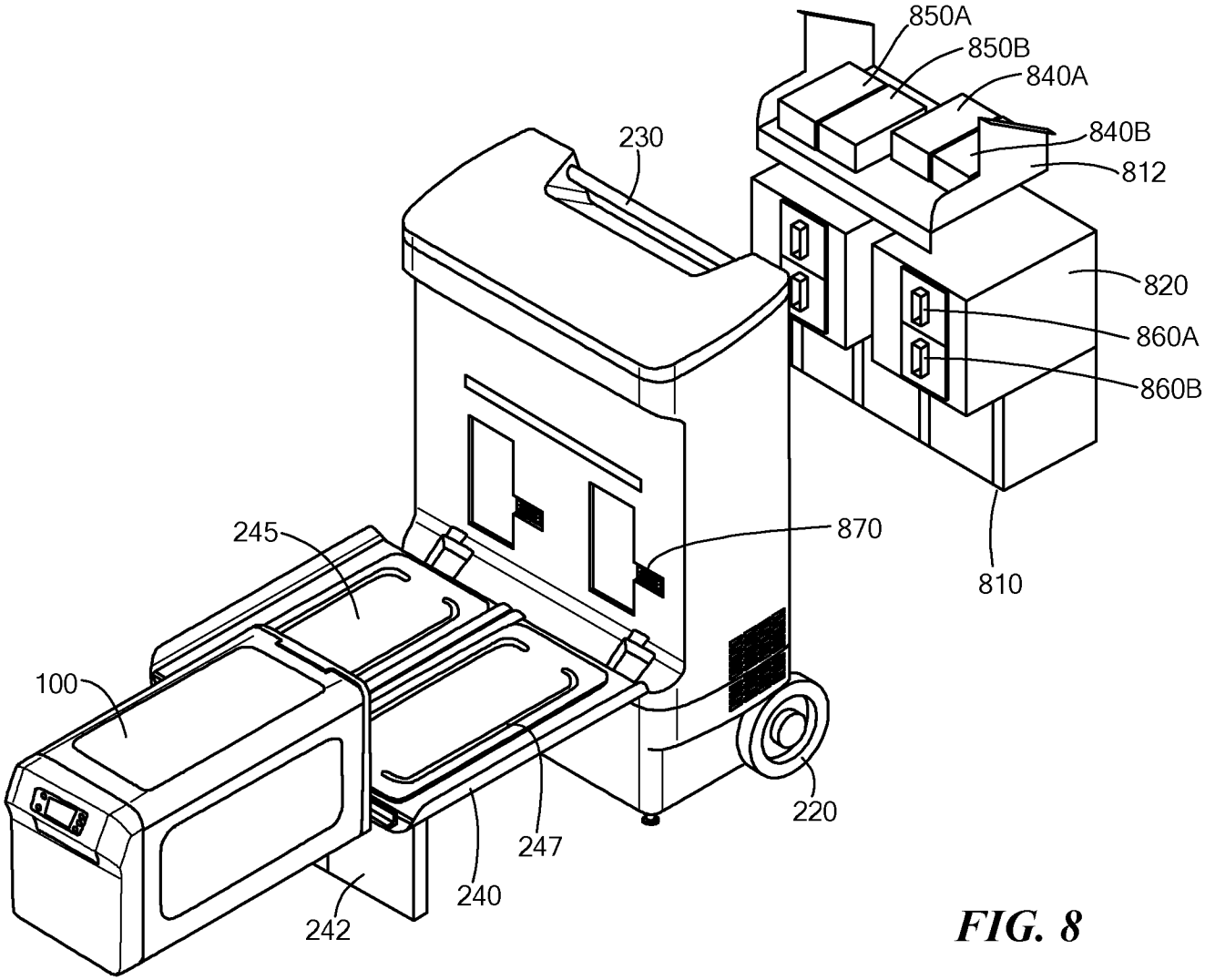
FIG. 8 shows an exploded view of the portable cooling device shown in FIGS. 2A-2C, in accordance with embodiments of the present invention.

FIG. 8 shows an exploded view of the cooling device 200. As mentioned above, to facilitate the portability of the cooling device 200, the cooling device 200 may have a body 210 with a pair of wheels 220 and a handle 230 that allows the cooling device to be easily transported from location to location. In addition to those components, the cooling device 200 may also have a refrigeration chassis 810 that holds the refrigeration units 820 and other refrigeration components within the cooling device 200. In this manner, if any of the refrigeration components (discussed in greater detail below) need to be repaired or replaced, a technician may simply remove the chassis 810 from the body 210 and remove/repair the problematic component(s).

Figure 9:
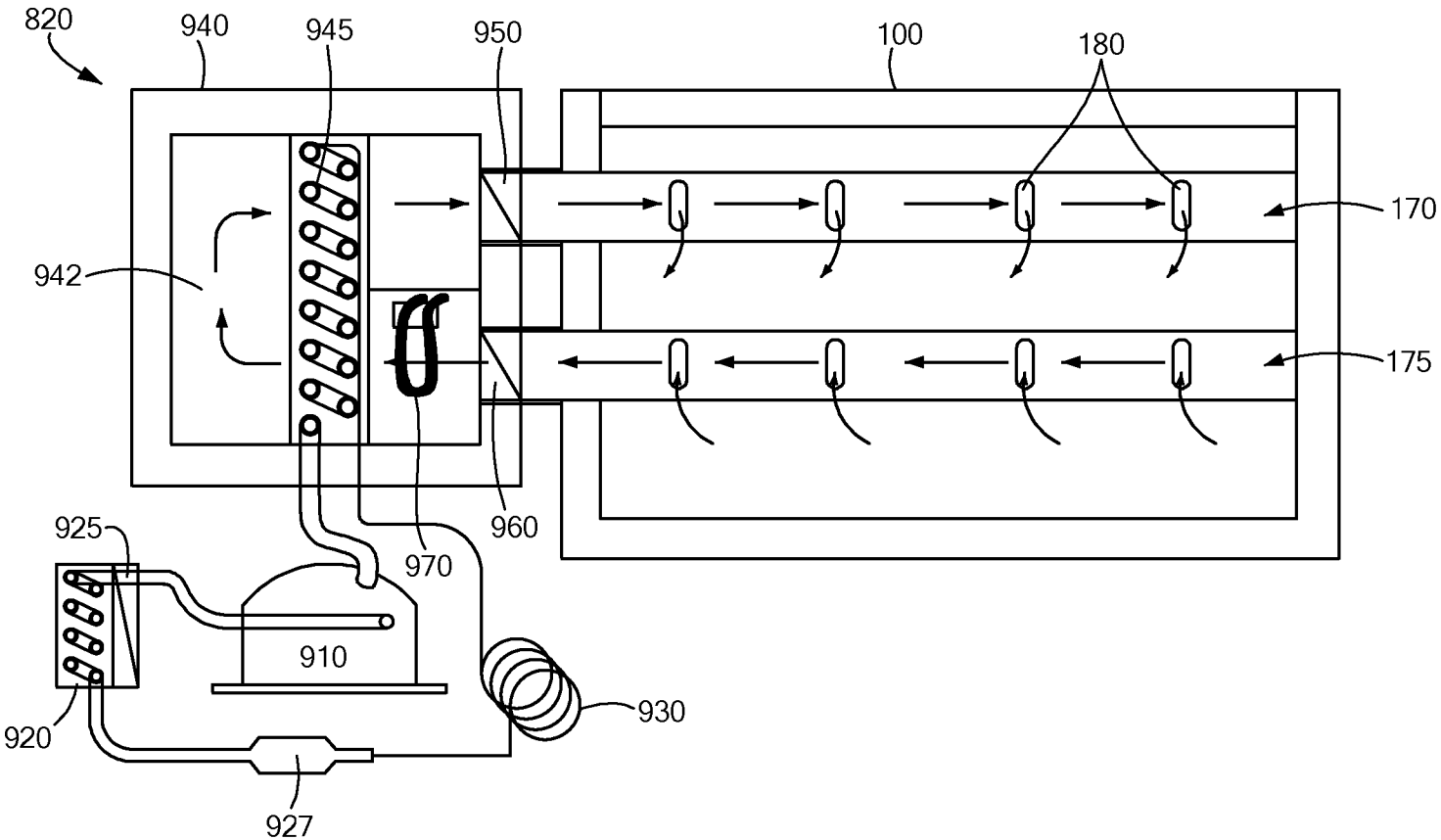
FIG. 9 shows the air flow through the storage device shown in FIG. 1 and the portable cooling device shown in FIGS. 2A-2C when docked, in accordance with embodiments of the present invention.

As shown in FIG. 9, each of the refrigeration units 820 may include a compressor 910, a condenser 920, and an evaporator 940. While in the compressor 910, the refrigerant may be compressed and then transferred to the condenser 920. While in the condenser, as the name suggest, heat exchange between the air and the refrigerant (e.g., facilitated by condenser fan 925) causes the refrigerant to condense. As the refrigerant exits the condenser 920 it may pass through a dryer 927 and enter a capillary tube 930. The capillary tube 930 increases the pressure of the refrigerant and creates a larger pressure differential as the refrigerant enters the evaporator coil 945. As the condensed refrigerant enters the evaporator coil 945, the pressure differential causes evaporation to occur. The evaporation process cools the air within the evaporation chamber 942. The cold/conditioned air within the evaporation chamber 942 may then be sent to the storage device 100 for active cooling.

To help facilitate the airflow within the system, the refrigeration unit 820 may also have a fan 950 to send the cold/conditioned air within the evaporation chamber 942 to the inlet duct 170 within the storage container. In a similar manner, the refrigeration unit 820 may also have a return fan 960 that may aid in drawing the warm air (e.g., the exhaust air) within the storage device 100 into the return duct 175 and back to the evaporator 940. As the returning air enters the evaporator 940, the air may pass over a heater element 970. The heated air may then pass over the bottom portion of the evaporator coil 945 and remove any ice built up on the evaporator coil 945 (e.g., as a result of the evaporation). After passing over the bottom portion of the coil 945, the air may then be re-cooled and recirculated back to the storage device 100 using the fan 950 and inlet duct 170. The heater 970 and fans 925/950/960 may be controlled by a heater relay 1060 and fan relay 1070, respectively (see FIG. 10).

Returning to FIG. 8, the chassis 810 may also have a shelf portion 812 where many of the other cooling device 200 components may be mounted. For example, the compressor modules 840A/840B that control the compressors 910 within the refrigeration units 820 and power supplies 850A/B for the refrigeration units 820 may be mounted on the shelf portion 812. Additionally, other components such as the wireless device/router and embedded server described in greater detail below may also be mounted on the shelf portion 812.

As mentioned above and as shown in FIG. 8, the cooling device 200 may have support platforms 240 that fold down from the body 210 to support the storage device 100. The embodiment shown in FIG. 8 has two such support platforms, therefore, the cooling device 200 shown in FIG. 8 can accommodate up to two storage devices 100. It is important to note that, although FIG. 8 shows a two storage device embodiment, the cooling device 200 can be configured to accommodate any number of storage devices 100 (e.g., by adding or removing refrigeration units 910 and support platforms 240).

To aid in docking the storage device 100 with the cooling device, the support platform 240 may have a sliding plate 245 with a groove 247 that helps align the storage device 100 on the support platform 245. For example the protrusion 119 on the bottom of the storage device 100 may rest within the grove 247. Once the storage device is properly aligned on the support platform 200, the user may slide the sliding plate 245 towards the cooler device body 210 and complete the docking process.

As the storage device 100 is docked with the cooling device 200, the inlet duct 170 and return duct 175 may be fluidly connected with refrigeration units 820. To that end, the evaporator may have evaporator ports 860A/B (e.g., a supply port 860A and a return/exhaust port 860B) extending outward from the refrigeration unit 820. Therefore, as the storage device 100 is slid into place using the sliding plate 245, the evaporator ports 860A/B may open the primary door assemblies 350/355 which, in turn, will open the secondary door assemblies 360/365, as described above. Once the door assemblies are open, the inlet duct 170 and the return duct 175 are in fluid communication with the refrigeration units 820. The cooling device 200 may then send cold/conditioned air from the evaporator to the storage device 100 through the inlet duct 170 and receive warm and/or exhaust air through the return duct 175 for recirculation in the refrigeration unit 820.

In addition to making fluid connections between the refrigeration units 820 and the inlet and return ducts 170/175, docking the storage device 100 with the cooling device 200 may also automatically connect electrical connector 195 on the storage device 100 with a corresponding electrical connector 870 on the cooling device 200. Once the electrical connectors 195 and 870 are connected, the controller 720 within the storage device 100 may transfer the above mentioned data to the cooling device 200. The cooling device 200 may then begin cooling the storage device 100 based, at least in part, upon the data received from the storage device 100. In some embodiments, the cooling device 200 may provide the storage device 100 with power and/or recharge any power sources within the storage device 100 via the electrical connectors 195/870. It should be understood that any type of electrical connection that allows the transfer of information and power may be used. For example, the electrical connectors 195/870 may be standard PIN type connectors, USB connectors, etc.

Figure 10A:
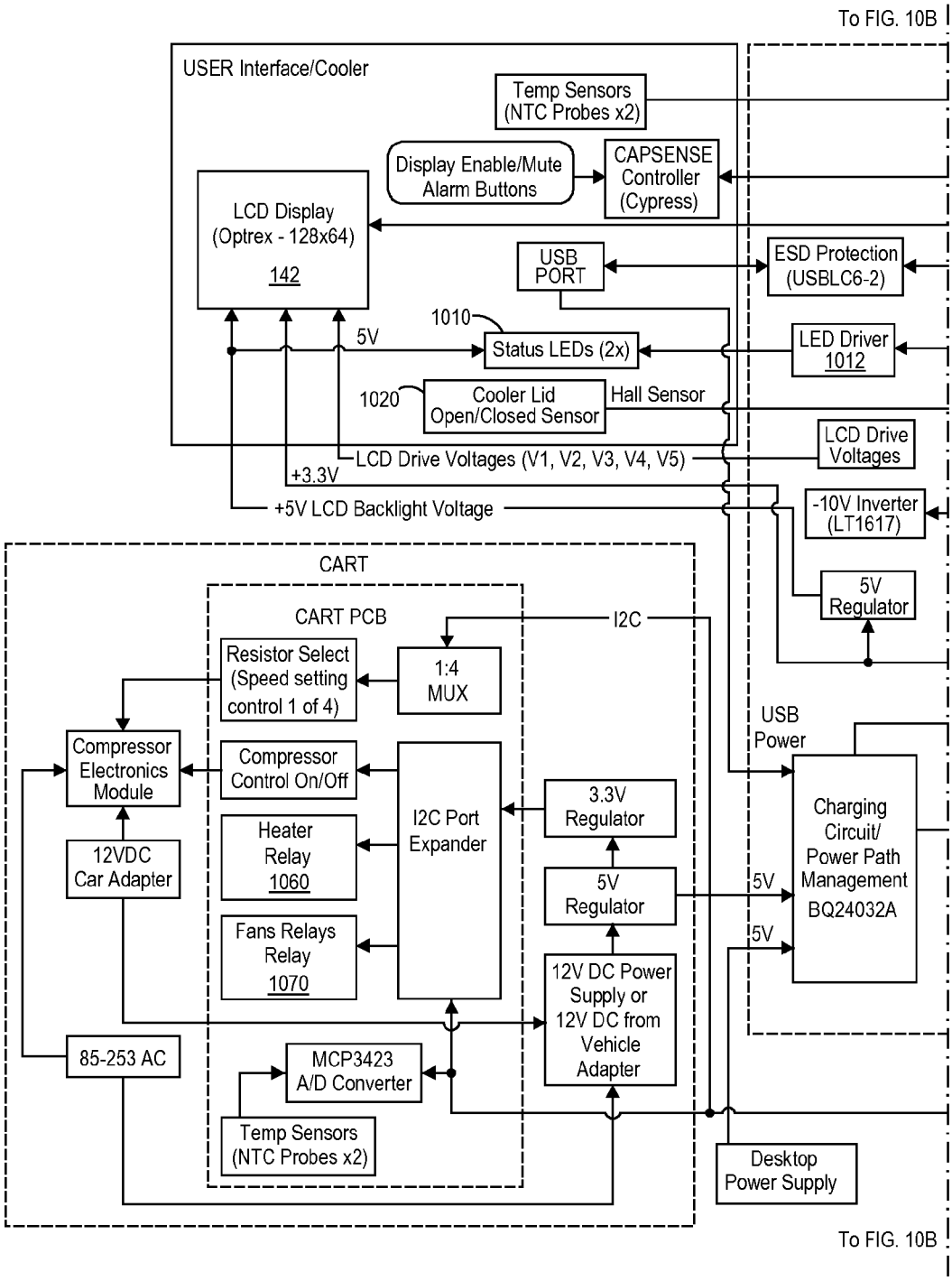
FIG. 10 shows a block diagram of the circuitry of the storage device shown in FIG. 1 and the portable cooling device shown in FIGS. 2A-2C, in accordance with embodiments of the present invention.
Figure 10B:
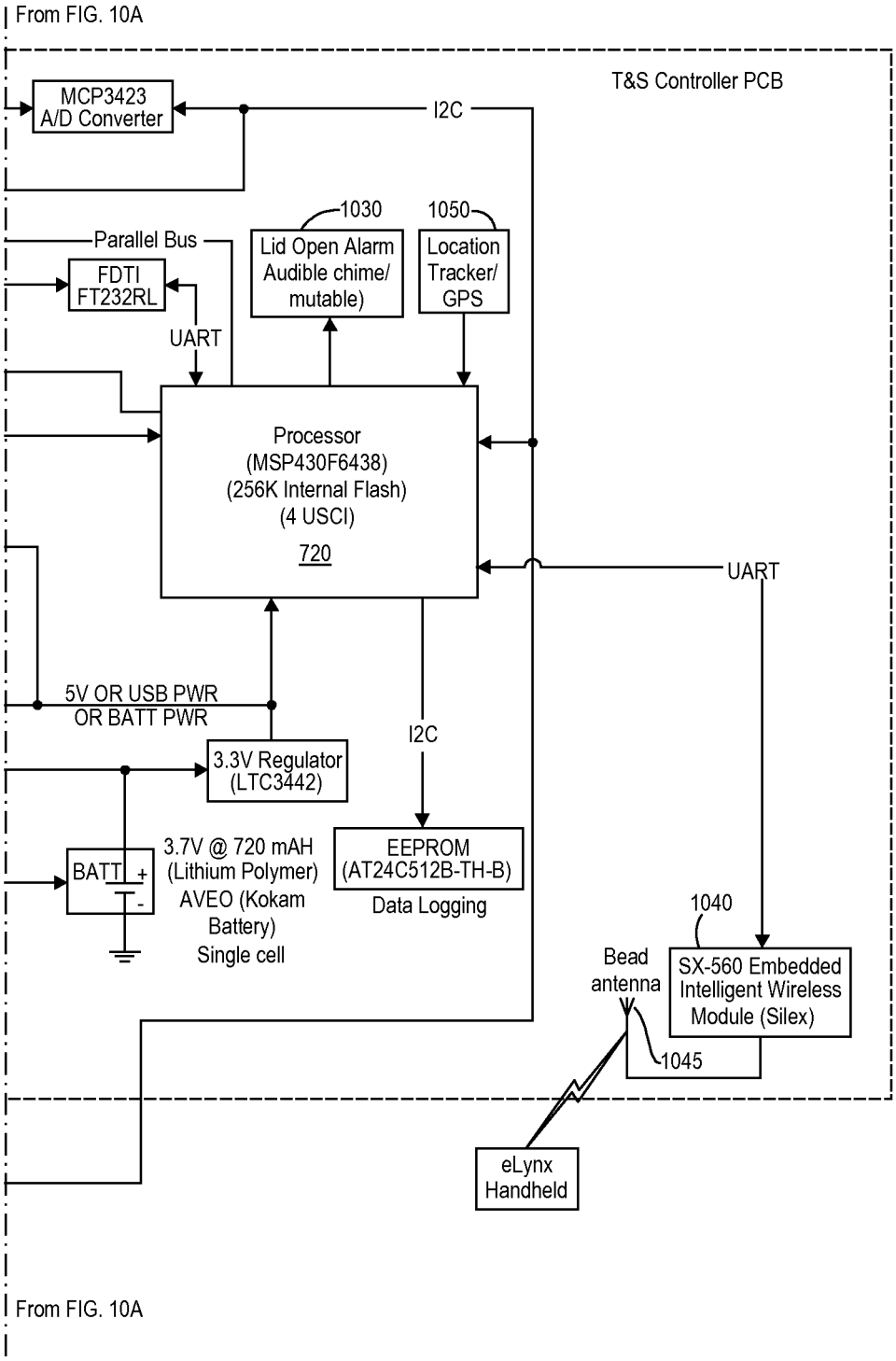

FIG. 10 shows a block diagram of the circuitry of the storage device 100 and the cooling device 200 as well as the communications and connections between them. As mentioned above the storage device 100 may have a control module 720 (e.g., a processor) that is connected to a user interface 140 and display 142. Embodiments of the present invention may also have a variety of other components and features that provide feedback to the user. For example, the user interface 140 and display may have a plurality of LEDs 1010 that are controlled by control module 720 and LED driver 1012. The LEDs may provide a visual indication of the status of the storage device (e.g., at temperature, above temperature, whether the storage device 100 is full, whether the storage device 100 is cooling, etc.) Additionally, the storage device 100 may have a lid sensor 1020 that sends a signal to the control module 720 when the lid 120 is open. In such embodiments, the storage device 100 may also have an audible alarm 1030 which the control module 720 may cause to chime when it receives a lid open signal from the lid sensor 1020.

Like the cooling device 200, the storage device 100 may also have a wireless module 1040 (e.g., a wireless access device, wireless access point device, wireless router, etc) and antenna 1045. The wireless module 1040 and antenna 1045 may be used to transmit storage device data to external devices. For example, the storage device 100 may transit the temperature data to a handheld device. Additionally, if the storage device 100 has a location tracker 1050 (e.g., a GPS), the storage device 100 may send the current location of the storage device 100 to an external device while the storage device 100 is in transmit. The wireless access device may provide wireless communication via IEEE 802.11 standard compatibility networks, cellular data networks, and location information via GPS networks, for example.

It is important to note that, although the above described embodiments describe devices and systems utilizing cooling and refrigeration units/devices, other embodiments of the present invention may include other conditioning devices. For example, some embodiments of the present invention may have conditioning devices that warm, cool, humidify, and/or dehumidify the air that is sent to the storage device 100.

The embodiments of the invention described above are intended to be merely exemplary; numerous variations and modifications will be apparent to those skilled in the art. All such variations and modifications are intended to be within the scope of the present invention as defined in any appended claims.

What is claimed is:

1. A portable blood storage device comprising:

an outer housing defining the structure of the blood storage device;

an inner housing located within the outer housing and having an interior cavity for storing a plurality of storage containers containing blood and/or blood components, the inner housing having an open top to allow access to the interior cavity;

a tubular inlet duct fluidly connectable to a cooling device and extending into and spanning at least a portion of the interior cavity of the storage device, the tubular inlet duct bringing conditioned air into the storage device when fluidly connected to the cooling device, the cooling device being separate from the portable blood storage device; and a tubular return duct fluidly connectable to the cooling device and extending into and spanning at least a portion of the interior cavity of the inner housing, the tubular return duct returning exhaust air to the cooling device when fluidly connected to the cooling device, wherein the portable blood storage device is adapted to be transported away from the cooling device.

2. A portable blood storage device according to claim 1, wherein the tubular inlet duct and the tubular return duct have a plurality of openings extending along a length of the tubular inlet duct and the tubular return duct, the plurality of openings allowing conditioned air within the tubular inlet duct to enter the interior cavity and exhaust air within the interior cavity to enter the tubular return duct.

3. A portable blood storage device according to claim 1 wherein the inner housing is spaced from the outer housing to create a volume between the inner housing and the outer housing, the volume containing an insulator medium.

4. A portable blood storage device according to claim 1 further comprising:

a shroud located across the open top of the inner housing and having a plurality of openings extending therethrough, the plurality of openings allowing access to the interior cavity.

5. A portable blood storage device according to claim 4, wherein each of the plurality of openings has at least one flap member, the at least one flap member preventing ambient air from entering the interior cavity from the open top and preventing conditioned air within the interior cavity from exiting the interior cavity from the open top.

6. A portable blood storage device according to claim 4, wherein the portable blood storage device is configured to allow the plurality of storage containers to hang within the interior cavity below the plurality of openings in the shroud.

7. A portable blood storage device according to claim 1, further comprising:

an inlet docking assembly between the tubular inlet duct and the cooling device, the inlet docking assembly automatically creating fluid communication between the tubular inlet duct and the cooling device when the storage device is docked with the cooling device, thereby allowing conditioned air to be transferred from the cooling device to the tubular inlet duct; and a return docking assembly located between the tubular return duct and the cooling device, the return docking assembly automatically creating fluid communication between the tubular return duct and the cooling device when the storage device is docked with the cooling device, thereby allowing exhaust air to be returned from the tubular return duct to the cooling device.

8. A portable blood storage device according to claim 7, wherein the inlet docking assembly includes a primary inlet door and a secondary inlet door, the primary inlet door opening as the storage device is docked with the cooling device, the primary inlet door opening the secondary inlet door, thereby creating fluid communication between the tubular inlet duct and the cooling device; and the return docking assembly includes a primary return door and a secondary return door, the primary return door opening as the storage device is docked with the cooling device, the primary return door opening the secondary return door, thereby creating fluid communication between the tubular return duct and the cooling device.

9. A portable blood storage device according to claim 8, wherein the primary inlet door and secondary inlet door automatically close when the storage device is removed from the cooling device, thereby fluidly disconnecting the tubular inlet duct from the cooling device; and the primary return door and secondary return door automatically close when the storage device is removed from the cooling device, thereby fluidly disconnecting the tubular return duct from the cooling device.

10. A portable blood storage device according to claim 1, further comprising:

at least one temperature sensor located within the interior cavity and measuring the temperature within the storage device; and a control module having a user interface, the control module displaying the storage device temperature.

11. A portable blood storage device according to claim 1 further comprising:

an electrical connector in electrical communication with at least one temperature sensor measuring the temperature within the interior of the storage device and electrically couplable with the cooling device, the electrical connector transferring blood storage device data to the cooling device.

12. A portable blood storage device according to claim 1, further comprising means for securing the plurality of blood and/or blood component storage containers within the interior cavity.

13. A portable blood storage device comprising:

an insulating housing defining the structure of the blood storage device and having an interior cavity for storing a plurality of storage containers containing blood and/or blood components, the insulating housing having an open top to allow access to the interior cavity;

a tubular inlet duct fluidly connectable to a cooling device and extending into and spanning at least a portion of the interior cavity of the storage device, the tubular inlet duct bringing conditioned air into the storage device when fluidly connected to the cooling device, the cooling device being separate from the portable blood storage device; and a tubular return duct fluidly connectable to the cooling device and extending into and spanning at least a portion of the interior cavity of the storage device, the tubular return duct returning exhaust air to the cooling device when fluidly connected to the cooling device, wherein the portable blood storage device is adapted to be transported away from the cooling device.

14. A portable blood storage device according to claim 13, wherein the portable blood storage device is configured to allow the plurality of storage containers to hang within the interior cavity.

15. A portable blood storage device according to claim 13, further comprising means for securing the plurality of blood and/or blood component containers within the interior cavity.

16. A portable biological-material storage device comprising:

an insulating housing defining the structure of the storage device and having an interior cavity for storing a plurality of storage containers containing biological material, the insulating housing having an open top to allow access to the interior cavity;

a tubular inlet duct fluidly connectable to a conditioning device and extending into and spanning at least a portion of the interior cavity of the storage device, the tubular inlet duct bringing conditioned air into the storage device when fluidly connected to the conditioning device, the conditioning device being separate from the portable blood storage device; and a tubular return duct fluidly connectable to the conditioning device and extending into and spanning at least a portion of the interior cavity of the storage device, the tubular return duct returning exhaust air to the conditioning device when fluidly connected to the conditioning device, wherein the portable blood storage device is adapted to be transported away from the cooling device.

17. A portable biological-material storage device according to claim 16, wherein the portable biological-material storage device is configured to allow the plurality of storage containers to hang within the interior cavity.

18. A portable biological-material storage device according to claim 17, further comprising:

a shroud located across the open top of the insulating housing and having a plurality of openings extending therethrough, the plurality of openings allowing access to the interior cavity.

19. A portable biological-material storage device according to claim 18, wherein the portable biological-material storage device is configured to allow the plurality of storage containers configured to hang below the plurality of openings.

20. A portable blood storage device according to claim 17, further comprising:

a shroud located across the open top of the insulator housing and having a plurality of openings extending therethrough, the plurality of openings allowing access to the interior cavity.

21. A portable blood storage device according to claim 20, wherein the portable blood storage device is configured to allow the plurality of storage containers to hang below the plurality of openings.

22. A portable biological-material storage device according to claim 16, further comprising means for securing the plurality of biological material storage containers within the interior cavity.

* * * * *